United States Patent [19]

Pigozzi

[11] Patent Number: 4,722,260

[45] Date of Patent: Feb. 2, 1988

[54] STRINGED MUSICAL INSTRUMENT HAVING RETRACTING FRETS

[76] Inventor: Gabriele Pigozzi, 34, Via Dante Aligheri, I-42015 Correggio Emilia, Italy

[21] Appl. No.: 914,143

[22] Filed: Oct. 1, 1986

[30] Foreign Application Priority Data

Oct. 1, 1985 [IT] Italy ..... 46854 A/85

[51] Int. Cl.[4] ..... G10D 3/06

[52] U.S. Cl. ..... 84/314 R

[58] Field of Search ..... 84/314 R

[56] References Cited

U.S. PATENT DOCUMENTS 1,727,230 9/1929 Cox ..... 84/314 R 4,297,936 11/1981 Mouton ..... 84/314 R

*Primary Examiner*—Lawrence R. Franklin

*Attorney, Agent, or Firm*—Birch, Stewart, Kolasch, & Birch

[57] ABSTRACT

A stringed musical instrument provided with a neck and body such as a guitar comprises a fingerboard the frets of which are retractable under the control of the player.

12 Claims, 5 Drawing Figures

STRINGED MUSICAL INSTRUMENT HAVING RETRACTING FRETS

BACKGROUND OF THE INVENTION

Known guitar-type musical instruments comprise a neck, on the surface of which a board known as a "fingerboard" is applied, and a resonance body over which the instrument strings are stretched. The body can be either of the acoustic type or electronic type, in this latter case it consisting of a solid block with one or more pick-ups which are disposed in proximity to the bridge to pick up the vibrations of the individual strings and feed them to suitable amplifiers.

Each of these strings is stretched between two projections known respectively as the "bridge" and "nut", which define its useful length.

During playing of the music, player of the instrument can vary the useful or active length of each string by pressing it against the fingerboard.

Each string can thus vibrate to emit sounds of different frequencies (musical notes) as a function of its tension and useful length, and of different intensities depending on the vibration amplitude.

The instruments of the aforesaid type are divided into two categories depending on the timbre and playing requirements of the player. In this respect, known instruments are either provided or not provided with frets, such a fret being generally a metal bar disposed transversely below the strings and rigid with the upper surface of the fingerboard.

In instruments provided with frets, the player presses with his fingers a string on the other side of a fret with respect to the body, so that the string rests against said fret and assumes a useful length equal to the distance between the fret and the bridge. By choosing the correct fret, he is able to obtain from the string a discrete series of notes of precisely defined timbre, and of metallic character due to the nature of the fret. In contrast, in instruments without frets, the useful length of the string is determined by the distance between the point at which the player keeps the string pressed against the fingerboard and the bridge. In the absence of the fret, the sound assumes a much softer character. The player has therefore the possibility of choosing at his own discretion the useful length of the string with the limitation due to the predetermined position of the frets.

Basically, the two instruments with or without frets emit sounds of very different characteristics and timbre, and the same player while playing one and the same piece may require instruments with and without frets at different moments.

At the present time, in particular for base guitars, each player has two instruments available, and where the playing pattern allows it he replaces one instrument with the other according to requirements. However, this greatly limits his playing range in that the rhythm of the music does not always allow him the time necessary for making the required replacement.

SUMMARY OF THE INVENTION

An object of the present invention is to provide an instrument of the aforesaid type, and in particular a base guitar, either electronic or acoustic, which obviates the aforesaid drawbacks in that it can be rapidly converted from an instrument with frets to an instrument without frets.

This object is attained according to the invention by an instrument, the neck of which is provided with retractable frets which can be raised above the upper surface of the fingerboard under the simple control of the operator.

The mechanism by which the raising and lowering of the fret assembly is implemented can be constructed in an infinity of different ways, and one embodiment thereof is illustrated hereinafter by way of a non-limiting example with reference to the accompanying drawings.

These drawings relate to an electric base guitar, but it is apparent that the invention can be applied without restriction to any type of stringed instrument provided with a neck and body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
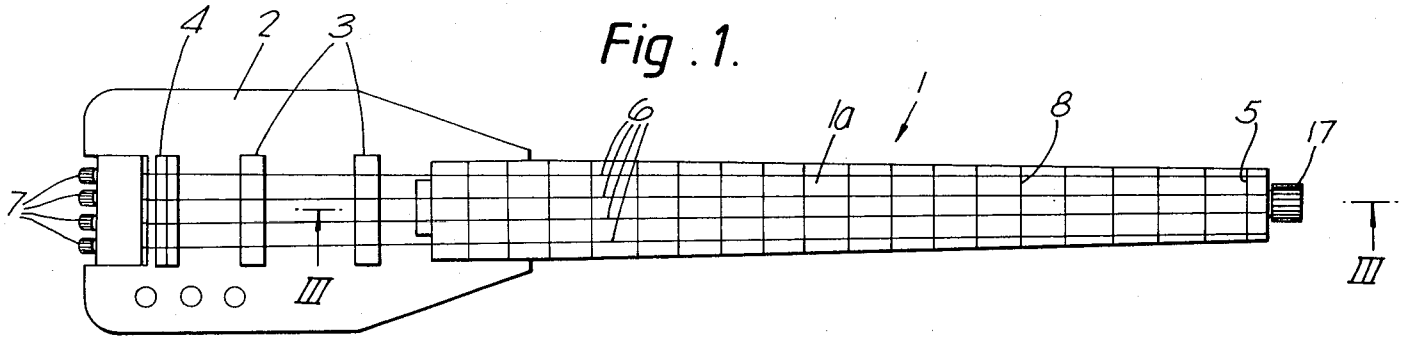
FIG. 1 is a plan view of an electric base guitar.
Figure 2:
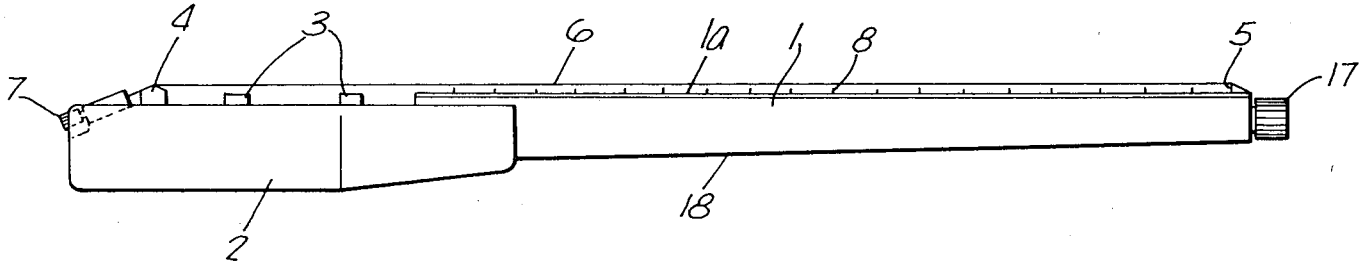
FIG. 2 is a side view thereof.
Figure 3:
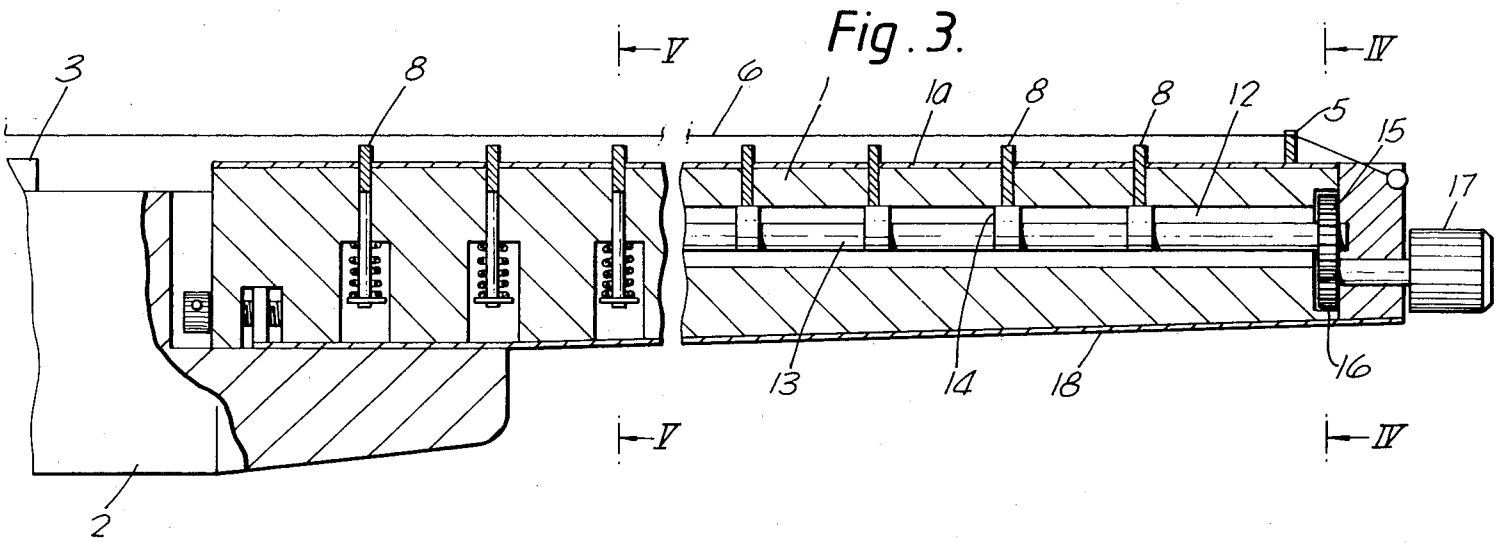
FIG. 3 is a section on the line III—III of FIG. 1.

The aforesaid figures show an instrument consisting of a neck 1, at the end of which there is provided a solid block 2 forming the body and carrying the pick-ups 3 and the bridge 4.

At the opposite end, the fingerboard 1a fixed on to the neck 1 comprises a projection 5 known as the "nut".

The strings 6 are stretched between the bridge 4 and projection 5, and their tension can be adjusted by the adjustment screws 7, one for each string.

On the top of the fingerboard 1a there is disposed a series of frets 8, of the usual number and distribution for the instrument, each of them being inserted into a seat in which it can slide, to be raised above the upper surface of said fingerboard or to be lowered at least to the level thereof.

Figure 5:
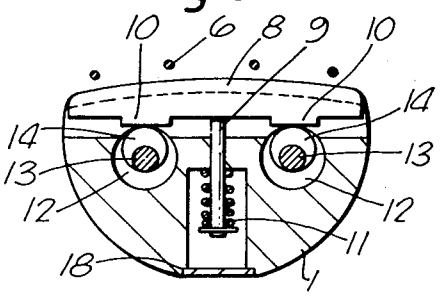
FIG. 5 is a section on the line V—V of FIG. 3.
Figure 4:
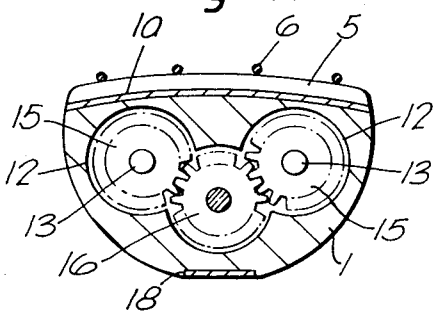
FIG. 4 is a section on the line IV—IV of FIG. 3.

The frets 8 are in the form shown in FIG. 5, and comprise an upper bar provided with a central stem 9 and two projections 10 to the sides of the stem.

The stem 9 extends into a lower cavity of the neck, in which a spring 11 urges it downwards such that the fret lies level with the fingerboard.

In a position below the projections 10, the neck comprises two longitudinal cavities 12 into which two shafts 13 are inserted.

In correspondence with each fret, each shaft 13 is provided with a cam 14 which acts on the respective projection 10, and when the shaft is rotated causes the fret 8 to rise above the level of the fingerboard.

For this purpose, each shaft 13 is provided with a gear wheel 15. Two two gears wheels 15 engage with the same central pinion 16, on the pin of which there is disposed an operating knob 17 at the end of the neck.

Between the body 2 and the end of the neck, in an opposite position to the strings 6, there is provided a stiffener 18 which prevents deformation of the neck induced by the tension of the strings.

A detailed description of the other parts of the instrument, such as the means for fixing the strings, the electrical part and other undefined parts, is omitted as these are conventional. The operation of the instrument is apparent, and allows the player to change from the configuration with frets to the configuration without frets or vice versa, in a very short time of the order of one second by simply rotating the knob 17 through little more than one quarter of a revolution.

The invention being thus described, it will be obvious that the same may be varied in many ways. Such variations are not the be regarded as a departure from the spirit and scope of the invention, and all such modifications as would be obvious to one skilled in the art are intended to be included within the scope of the following claim.

I claim:

1. A stringed musical instrument, said instrument comprising:
- a neck;
- a fingerboard disposed on said neck;
- a resonance body connected to one end of said neck;
- a bridge positioned on said resonance body;
- a nut positioned on said neck;
- a plurality of strings extending between said bridge and said nut;
- a plurality of frets slidably disposed within said neck and through said fingerboard at positions along the length of said neck;
- shaft means, provided with a plurality of cams, rotataby disposed within said neck for engaging and actuating said frets;
- biasing means for biasing said frets into a retracted position and into engagement with said cams of said shaft means; and
- means for rotating said shaft for simultaneously actuating said plurality of frets to an extended or retracted position.

2. The instrument according to claim 1, wherein said shaft means comprises two parallel shafts each provided with a gear wheel at one end, and said means for rotating said shaft comprises a pinion engaging said gear wheels of said shafts, said instrument includes an external operating member connected to said pinion.

3. The instrument according to claim 2, wherein said external operating member comprises a knob extending from an opposite end of said neck, and connected to said pinion for rotating said pinion.

4. The instrument according to claim 2, wherein said biasing means comprises a stem extending from each fret with each stem extending through a hole into a cavity in said neck, and a spring disposed within said cavity acting against a portion of said cavity and an end member connected to each stem for biasing each fret into a retracted position.

5. The instrument according to claim 4, wherein said stem of each fret is positioned in between said two parallel shafts, and each fret is provided with two projections wherein one projection engages with one cam of one shaft and the other projection engages with one cam of the other shaft.

6. The instrument according to claim 1, wherein said biasing means comprises a stem extending from each fret with each stem extending through a hole into a cavity in said neck, and a spring disposed within said cavity acting against a portion of said cavity and an end member connected to each stem for biasing each fret into a retracted position.

7. The instrument according to claim 1, wherein said resonance body is a solid body provided with pick-ups.

8. The instrument according to claim 7, wherein said instrument is an electronic bass guitar.

9. The instrument according to claim 1, wherein said instrument is of an acoustic guitar.

10. A stringed musical instrument, said instrument comprising:
- a neck;
- a fingerboard carried on said neck;
- a solid body carried on said neck;
- a plurality of pick-ups carried on said body;
- a plurality of frets slidably received within a series of transverse grooves in said neck and fingerboard;
- a single external control;
- means, simultaneously operable by said single external control, for causing all said frets to translate simultaneously such that said frets become positioned projecting from the upper surface of said fingerboard or completely retracted into each respective groove;
- two shafts disposed within two seats located below a row of said frets in said housing, said shafts each provided with a number of cams equal to the number of frets for engaging with projections extending from each fret;
- two gear wheels each position at an end of each shaft; and
- a pinion engaging with said two gear wheels, said pinion being connected to said external operating number.

11. The instrument according to claim 10, wherein the grooves are of a conventional number and distribution for the type of instrument in the fingerboard of which they are provided.

12. The instrument according to claim 10, wherein each fret is in the form of a transverse bar provided with a central positioned stem and two projections disposed symmetrically to the sides of said bar with respect to said stem, said stem extending into a cavity provided in a lower part of said neck with a spring retaining said stem and the respective fret in its retracted position.

* * * * *